US011339967B2

(12) United States Patent
Tentorio et al.

(10) Patent No.: US 11,339,967 B2
(45) Date of Patent: May 24, 2022

(54) FUEL INJECTOR

(71) Applicants: ROLLS-ROYCE plc, London (GB); ROLLS-ROYCE DEUTSCHLAND LTD & CO KG, Dahlewitz (DE)

(72) Inventors: Luca Tentorio, Derby (GB); Juan Carlos Roman Casado, Derby (GB); Giacomo Di Chiaro, Derby (GB); Jonathan Knapton, Derby (GB); Filippo Zambon, Derby (GB); Radu Irimia, Derby (GB); Imon-Kalyan Bagchi, Berlin (DE); James Robins, Birmingham (GB)

(73) Assignees: ROLLS-ROYCE plc, London (GB); ROLLS-ROYCE DEUTSCHLAND LTD & CO KG, Dahlewitz (DE)

( * ) Notice: Subject to any disclaimer, the term of this patent is extended or adjusted under 35 U.S.C. 154(b) by 0 days.

(21) Appl. No.: 16/903,479

(22) Filed: Jun. 17, 2020

(65) Prior Publication Data

US 2020/0408408 A1 Dec. 31, 2020

(30) Foreign Application Priority Data

Jun. 26, 2019 (GB) ..... 1909167

(51) Int. Cl.
*F23R 3/14* (2006.01)
*F23R 3/34* (2006.01)

(52) U.S. Cl.
CPC ..... *F23R 3/14* (2013.01); *F23R 3/343* (2013.01)

(58) Field of Classification Search
CPC .. F23R 3/343; F23R 3/14; F23R 3/283; F23R 2900/00004; F23C 7/004
See application file for complete search history.

(56) References Cited

U.S. PATENT DOCUMENTS 6,457,316 B1 * 10/2002 Czachor ..... F23R 3/283 60/742
2007/0193272 A1 8/2007 Hebert et al.
2009/0140073 A1 * 6/2009 Thomson ..... F23R 3/28 239/128
2009/0211256 A1 * 8/2009 Williams ..... F23K 5/20 60/739
2010/0269506 A1 * 10/2010 Nonaka ..... F23R 3/343 60/742

(Continued)

FOREIGN PATENT DOCUMENTS

EP 1 719 950 A2 11/2006
EP 2 963 267 A1 1/2016

(Continued)

OTHER PUBLICATIONS

Oct. 23, 2020 Extended European Search Report issued in European Patent Application No. 20181589.1.

(Continued)

*Primary Examiner* — Gerald L Sung
(74) *Attorney, Agent, or Firm* — Oliff PLC

(57) ABSTRACT

A fuel injector including: a plurality of air swirler passages; at least one fuel supply passage arranged to supply fuel into at least one of the air swirler passages; and at least one cavity separating an exterior of the fuel supply passage from a body of the fuel injector; wherein the cavity is at least partially filled with a thermally insulating material.

12 Claims, 5 Drawing Sheets

(56) References Cited

U.S. PATENT DOCUMENTS

| | | | | |
|---|---|---|---|---|
| 2012/0198853 | A1 | 8/2012 | Hernandez et al. | |
| 2012/0260663 | A1* | 10/2012 | Pidcock | F02C 7/222 60/772 |
| 2012/0291449 | A1* | 11/2012 | Adams | F02C 3/107 60/793 |
| 2013/0186059 | A1* | 7/2013 | Epstein | F02C 7/224 60/205 |
| 2016/0003380 | A1* | 1/2016 | Ott | B33Y 80/00 138/149 |
| 2017/0122212 | A1* | 5/2017 | Cadman | F23R 3/28 |

FOREIGN PATENT DOCUMENTS

| | | | |
|---|---|---|---|
| EP | 3 184 782 | A1 | 6/2017 |
| EP | 3 537 048 | A1 | 9/2019 |
| WO | 01/01041 | A1 | 1/2001 |
| WO | 2009/039142 | A2 | 3/2009 |
| WO | 2009/148680 | A2 | 12/2009 |
| WO | 2013/139086 | A1 | 9/2013 |

OTHER PUBLICATIONS

Dec. 17, 2019 British Search Report issued in British Patent Applicaiton No. 1909167.7.

* cited by examiner

FUEL INJECTOR

CROSS-REFERENCE TO RELATED APPLICATIONS

This specification is based upon and claims the benefit of priority from United Kingdom patent application number GB 1909167.7 filed on Jun. 26, 2019, the entire contents of which are incorporated herein by reference.

BACKGROUND

Field of the Disclosure

The invention relates to a fuel injector, a gas turbine engine for an aircraft, a stationary gas turbine and an industrial combustor.

Background of the Disclosure

Fuel injectors are provided to deliver fuel into the combustion chamber of combustion equipment of, for example, a gas turbine engine. The combustion equipment is a particularly hot and high pressure region of the engine. It is desirable to keep the temperature of surfaces of the fuel injector down so as to reduce degradation in the quality or lifetime of the fuel injector.

For example, carbonaceous deposits can form on walls of the fuel injector. This can reduce the performance of the fuel injector. Furthermore, carbonaceous deposits can build up to an extent that they interfere with the movement or position of other parts of the fuel injector. This can lead to failure of the fuel injector.

It is an aim of the present disclosure to provide a fuel injector which is more resistant to carbonaceous deposits.

SUMMARY OF THE DISCLOSURE

According to a first aspect there is provided a fuel injector comprising: a plurality of air swirler passages; at least one fuel supply passage arranged to supply fuel into at least one of the air swirler passages; and at least one cavity separating an exterior of the fuel supply passage from a body of the fuel injector; wherein the cavity is at least partially filled with a thermally insulating material.

In an arrangement, the thermally insulating material has a lower thermal conductivity than air.

In an arrangement, the thermally insulating material is arranged to block fuel supplied by the fuel supply passage from entering the cavity. In an arrangement, the thermally insulating material fills an opening where the cavity opens to the environment.

In an arrangement, the fuel injector comprises a pilot fuel supply passage and a main fuel supply passage, wherein neither of the pilot fuel supply passage and the main fuel supply passage surrounds the other. In an arrangement, the fuel injector comprises a fuel feed arm having a pilot fuel supply passage and a main fuel supply passage extending axially through it. In an arrangement, the pilot fuel supply passage and the main fuel supply passage are eccentric to each other as they extend through the fuel feed arm. In an arrangement, the cavity is radially outward of the fuel supply passages and radially inward of the part of the body that defines the fuel feed arm.

In an arrangement, the fuel injector comprises: a fuel injector head having a coaxial arrangement of an inner air swirler passage and an outer air swirler passage, wherein:

the cavity is radially inward of the fuel supply passage and radially outward of the part of the body that defines the inner air swirler passage; and/or the cavity is radially outward of the fuel supply passage and radially inward of the part of the body that defines the outer air swirler passage.

In an arrangement, the cavity is unsealed to the environment. In an arrangement, the body of the fuel injector comprises at least one access hole for allowing the thermally insulating material to be injected into the cavity from the exterior of the fuel injector. In an arrangement, the thermally insulating material comprises an aerogel. In an arrangement, the fuel injector is a lean burn fuel injector.

In an arrangement, the fuel injector comprises a fuel feed arm and a fuel injector head, the fuel feed arm having a pilot fuel supply passage and a main fuel supply passage extending through it, the fuel injector head having a coaxial arrangement of an inner pilot air-blast fuel injector and an outer main air-blast fuel injector, the outer main air-blast fuel injector being arranged coaxially radially outwardly of the inner pilot air-blast fuel injector, the inner pilot air-blast fuel injector comprising, in order radially outwardly, a coaxial arrangement of a pilot inner air swirler passage and a pilot outer air swirler passage, the pilot fuel supply passage being arranged to supply pilot fuel into at least one of the pilot inner air swirler passage and the pilot outer air swirler passage, the outer main air-blast fuel injector comprising, in order radially outwardly, a coaxial arrangement of a main inner air swirler passage and a main outer air swirler passage, the main fuel supply passage being arranged to supply main fuel into at least one of the main inner air swirler passage and the main outer air swirler passage.

In an arrangement, the fuel injector comprises: a first splitter member being arranged radially between the main inner air swirler passage and the pilot outer air swirler passage, the first splitter member having a frusto-conical divergent downstream portion; and a second splitter member being arranged radially within and radially spaced from the first splitter member, the second splitter member having a frusto-conical convergent portion, a downstream end of the second splitter member being arranged upstream of a downstream end of the first splitter member.

According to a second aspect there is provided a gas turbine engine for an aircraft comprising: an engine core comprising combustion equipment, a turbine, a compressor, and a core shaft connecting the turbine to the compressor; a fan located upstream of the engine core, the fan comprising a plurality of fan blades; and a gearbox that receives an input from the core shaft and outputs drive to the fan so as to drive the fan at a lower rotational speed than the core shaft; wherein the combustion equipment comprises at least one of the fuel injector described above.

In an arrangement the turbine is a first turbine, the compressor is a first compressor, and the core shaft is a first core shaft; the engine core further comprises a second turbine, a second compressor, and a second core shaft connecting the second turbine to the second compressor; and the second turbine, second compressor, and second core shaft are arranged to rotate at a higher rotational speed than the first core shaft.

According to a third aspect there is provided a stationary gas turbine comprising at least one of the fuel injector described above.

According to a fourth aspect there is provided an industrial combustor comprising at least one of the fuel injector described above.

BRIEF DESCRIPTION OF THE DRAWINGS

Embodiments will now be described by way of example only, with reference to the Figures, in which.

DETAILED DESCRIPTION OF THE DISCLOSURE

Figure 1:
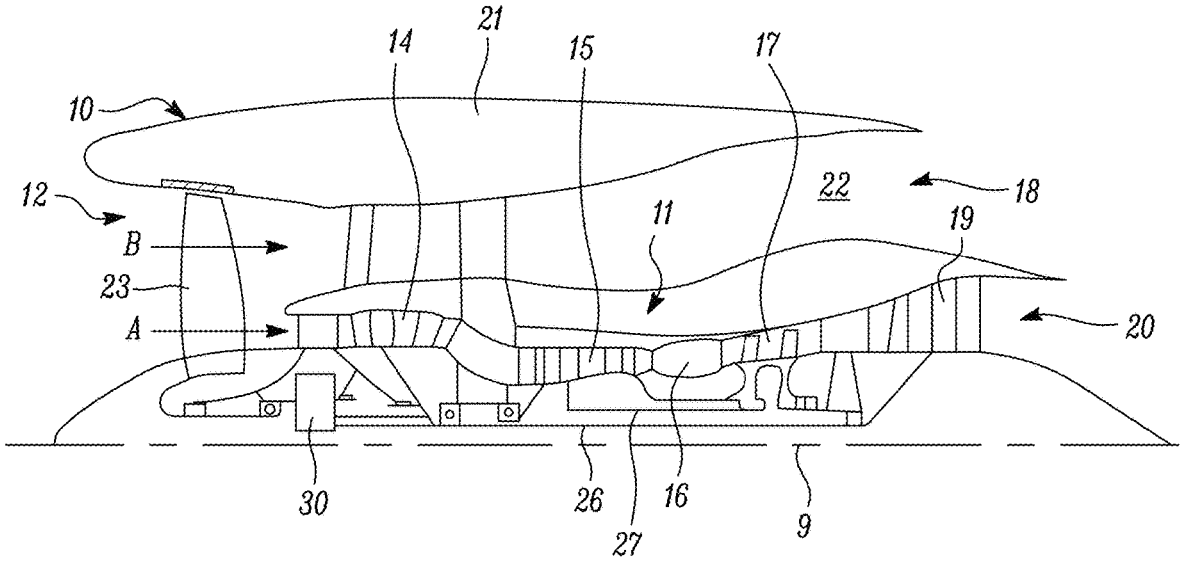
FIG. 1 is a sectional side view of a gas turbine engine.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds). These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform.

The radius of the fan may be measured between the engine centreline and the tip of a fan blade at its leading edge. The fan diameter (which may simply be twice the radius of the fan) may be greater than (or on the order of) any of: 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm or 390 cm (around 155 inches). The fan diameter may be in an inclusive range bounded by any two of the values in the previous sentence (i.e. the values may form upper or lower bounds).

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 250 cm to 300 cm (for example 250 cm to 280 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 320 cm to 380 cm may be in the range of from 1200 rpm to 2000 rpm, for example in the range of from 1300 rpm to 1800 rpm, for example in the range of from 1400 rpm to 1600 rpm.

In use of the gas turbine engine, the fan (with associated fan blades) rotates about a rotational axis. This rotation results in the tip of the fan blade moving with a velocity $U_{tip}$. The work done by the fan blades on the flow results in an enthalpy rise dH of the flow. A fan tip loading may be defined as $dH/U_{tip}^2$, where dH is the enthalpy rise (for example the 1-D average enthalpy rise) across the fan and $U_{ti}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.3, 0.31, 0.32, 0.33, 0.34, 0.35, 0.36, 0.37, 0.38, 0.39 or 0.4 (all units in this paragraph being $Jkg^{-1}K^{-1}/(ms^{-1})^2$). The fan tip loading may be in an inclusive range bounded by any two of the values in the previous sentence (i.e. the values may form upper or lower bounds).

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, or 17. The bypass ratio may be in an inclusive range bounded by any two of the values in the previous sentence (i.e. the values may form upper or lower bounds). The bypass duct may be substantially annular. The bypass duct may be radially outside the engine core. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds).

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e. the values may form upper or lower bounds). Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400 K, 1450 K, 1500 K, 1550 K, 1600 K or 1650 K. The TET at cruise may be in an inclusive range bounded by any two of the values in the previous sentence (i.e. the values may form upper or lower bounds). The maximum TET in use of the engine may be, for example, at least (or on the order of) any of the following: 1700 K, 1750 K, 1800 K, 1850 K, 1900 K, 1950 K or 2000 K. The maximum TET may be in an inclusive range bounded by any two of the values in the previous sentence (i.e. the values may form upper or lower bounds). The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades maybe formed integrally with a central portion. Such an arrangement may be referred to as a blisk or a bling. Any suitable method may be used to manufacture such a blisk or bling. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 16, 18, 20, or 22 fan blades.

As used herein, cruise conditions may mean cruise conditions of an aircraft to which the gas turbine engine is attached. Such cruise conditions may be conventionally defined as the conditions at mid-cruise, for example the conditions experienced by the aircraft and/or engine at the midpoint (in terms of time and/or distance) between top of climb and start of decent.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be the cruise condition. For some aircraft, the cruise conditions may be outside these ranges, for example below Mach 0.7 or above Mach 0.9.

Purely by way of example, the cruise conditions may correspond to standard atmospheric conditions at an altitude that is in the range of from 10000 m to 15000 m, for example in the range of from 10000 m to 12000 m, for example in the range of from 10400 m to 11600 m (around 38000 ft), for example in the range of from 10500 M to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to: a forward Mach number of 0.8; a pressure of 23000 Pa; and a temperature of −55 degrees C.

As used anywhere herein, "cruise" or "cruise conditions" may mean the aerodynamic design point. Such an aerodynamic design point (or ADP) may correspond to the conditions (comprising, for example, one or more of the Mach Number, environmental conditions and thrust requirement) for which the fan is designed to operate. This may mean, for example, the conditions at which the fan (or gas turbine engine) is designed to have optimum efficiency.

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
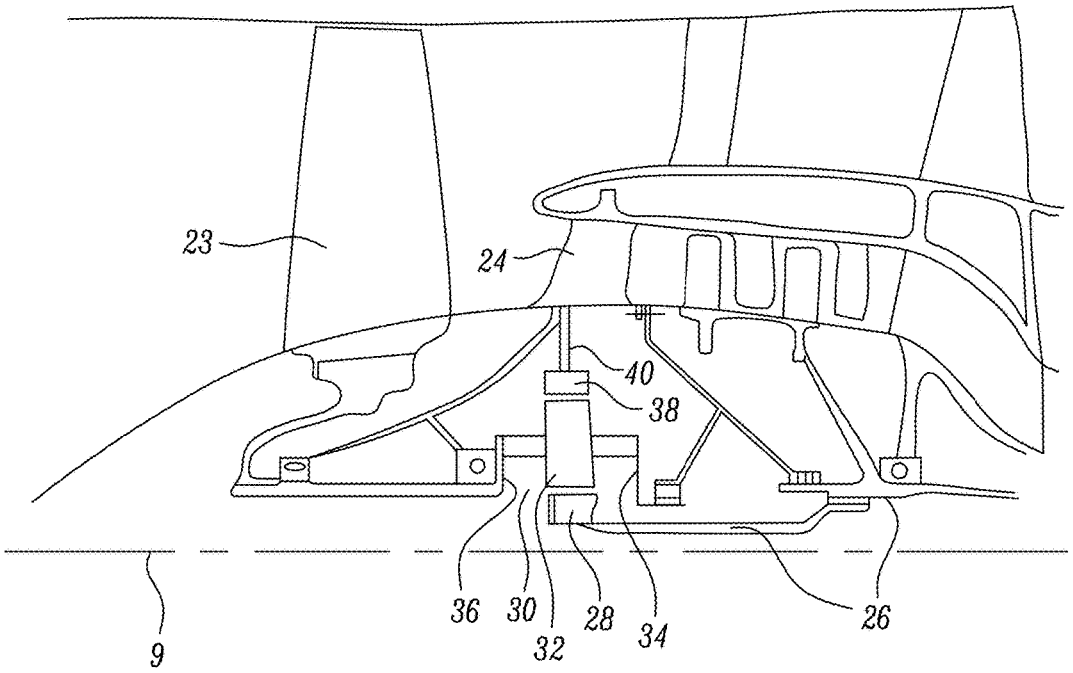
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
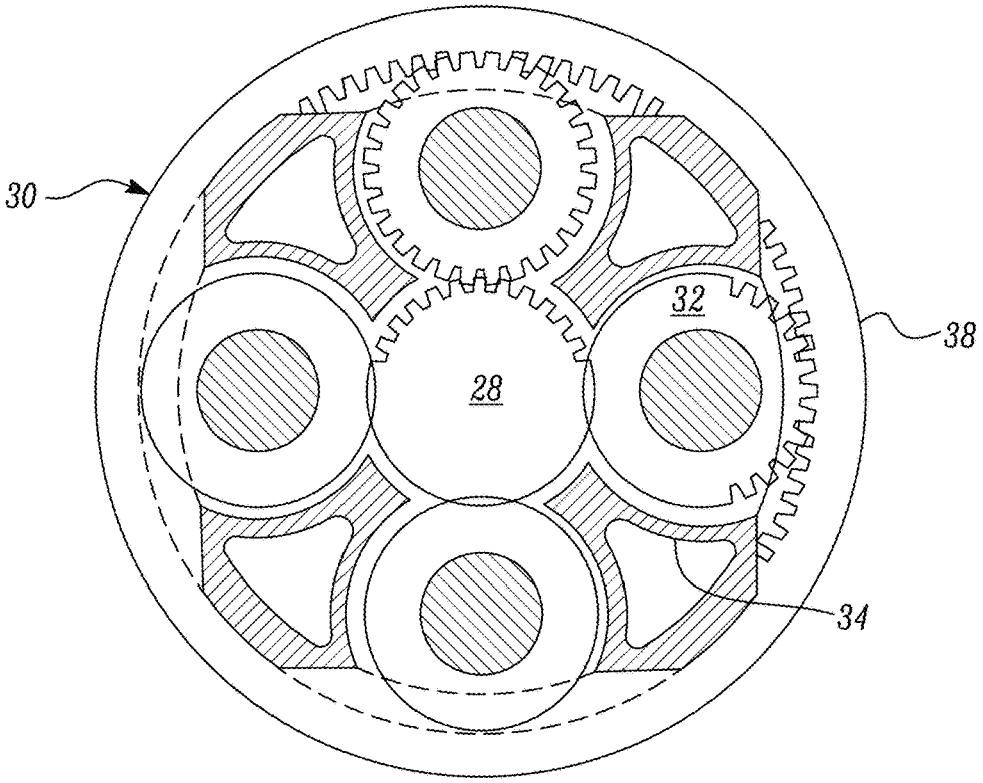
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 20, 22 meaning that the flow through the bypass duct 22 has its own nozzle that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
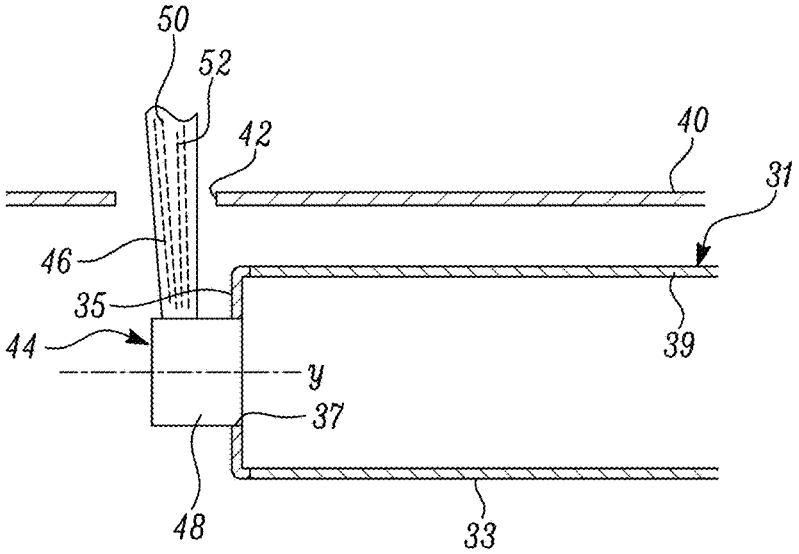
FIG. 4 is an enlarged cross-sectional view of combustion equipment of the gas turbine engine.

The combustion equipment 16 is shown more clearly in FIG. 4. The combustion equipment 16 comprises an annular combustion chamber defined by an inner annular wall 33, an outer annular wall 31 and an upstream wall 35. The upstream end wall 35 has a plurality of circumferentially spaced apertures, for example equi-circumferentially spaced apertures, 37. The combustion chamber is surrounded by a combustion chamber casing 40 and the combustion chamber casing 40 has a plurality of circumferentially spaced apertures 42. The combustion equipment 16 also comprises a plurality of fuel injectors 44 and each fuel injector 44 extends radially through a corresponding one of the apertures 42 in the combustion chamber casing 40 and locates in a corresponding one of the apertures 37 in the upstream end wall 35 of the combustion chamber to supply fuel into the combustion chamber.

Figure 5:
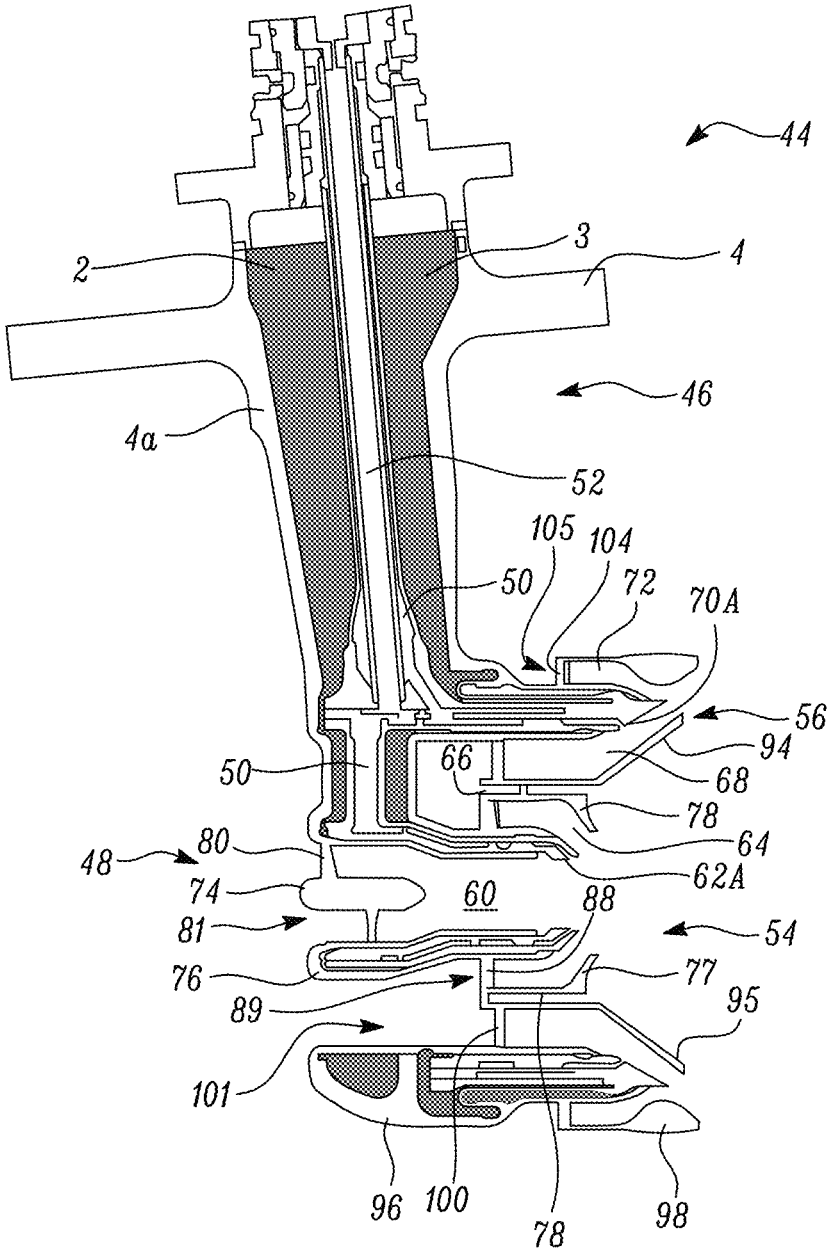
FIG. 5 is a cross-sectional view of a fuel injector of the combustion equipment.

A fuel injector 44 according to the present disclosure is shown more clearly in FIG. 5. The fuel injector 44 comprises a fuel feed arm 46 and a fuel injector head 48. The fuel feed arm 46 has a first internal fuel passage, a pilot fuel supply passage, 50 for the supply of pilot fuel to the fuel injector head 48 and a second internal fuel passage, a main supply fuel passage, 52 for the supply of main fuel to the fuel injector head 48. The fuel injector head 48 has an axis Y and the fuel feed arm 46 extends generally radially with respect to the axis Y of the fuel injector head 48 and also generally radially with respect to the axis X of the gas turbine engine 10. The axis Y of each fuel injector head 48 is generally aligned with the axis of the corresponding aperture 37 in the upstream end wall 35 of the combustion chamber.

The fuel injector head 48 has a coaxial arrangement of an inner pilot air-blast fuel injector 54 and an outer main air-blast fuel injector 56. The inner pilot air-blast fuel injector 54 comprises, in order radially outwardly, a coaxial arrangement of a pilot inner air swirler passage 60, a pilot fuel passage 62 and a pilot outer air swirler passage 64. The outer main air-blast fuel injector 56 comprises, in order radially outwardly, a coaxial arrangement of a main inner air swirler passage 68, a main fuel passage 70 and a main outer air swirler passage 72. An intermediate air swirler passage may be sandwiched between the pilot outer air swirler passage 64 of the inner pilot air-blast fuel injector 54 and the main inner air swirler passage 68 of the outer main air-blast fuel injector 56.

The fuel injector head 48 comprises a first generally cylindrical member 74, a second generally annular member 76 spaced coaxially around the first member 74 and a third generally annular member 78 spaced coaxially around the second annular member 76. A plurality of circumferentially spaced swirl vanes 80 extend radially between the first member 74 and the second annular member 76 to form a first air swirler 81. The second annular member 76 has a greater axial length than the first member 74 and the first member 74 is positioned at an upstream end of the second annular member 76.

The second annular member 76 houses part of one or more internal fuel supply passages 50, 52 which are arranged to receive fuel from the fuel feed arm 46. The pilot fuel supply passages 50 is arranged to supply fuel to a fuel swirler (not shown) which supplies a film of fuel through outlet 62A onto a radially inner surface, a pre-filming surface, 86 (shown in FIG. 6) at a downstream end of the second annular member 76. A plurality of circumferentially spaced swirl vanes 88 extend radially between the second annular member 76 and the third annular member 78 to form a second air swirler 89. The second annular member 76 has a greater axial length than the third annular member 78 and the third annular member 78 is positioned at the downstream end of the second annular member 76.

The downstream end of the third annular member 78 comprises a frusto-conical convergent portion 77 and optionally a frusto-conical divergent downstream portion. In operation the pilot fuel supplied by the internal fuel supply passages 50 and fuel swirler onto the radially inner surface 86 of the second annular member 76 is atomised by swirling flows of air from the swirl vanes 80 and 88 of the first and second air swirlers 81 and 89 respectively. The pilot inner air swirler passage 60 and the pilot outer air swirler passage 64 are arranged to swirl the air in opposite directions. Alternatively, the pilot inner air swirler passage 60 and the pilot outer air swirler passage 64 may be arranged to swirl the air in the same direction.

The fuel injector head 48 also comprises a fourth generally annular member 94 spaced coaxially around the third annular member 78, a fifth generally annular member 96 spaced coaxially around the fourth annular member 94 and a sixth generally annular member 98 spaced coaxially around the fifth annular member 96. The sixth generally annular member 98 may also be called a shroud. A plurality of circumferentially spaced swirl vanes 100 extend radially between the fourth annular member 94 and the fifth annular member 96 to form a third air swirler 101. The fifth annular member 96 has a greater axial length than the fourth annular member 94 and the fourth annular member 94 is positioned at the downstream end of the fifth annular member 96. The fifth annular member 96 has one or more internal fuel supply passages 50, 52 which are arranged to receive fuel from the fuel feed arm 46. The main fuel supply passage 52 is arranged to supply fuel to a fuel swirler (not shown) which supplies a film of fuel through outlet 70A onto the radially inner surface, a pre-filming surface, 102 (shown in FIG. 7) at the downstream end of the fifth annular member 96. A plurality of circumferentially spaced swirl vanes 104 extend radially between the fifth annular member 96 and the sixth annular member 98 to form a fourth air swirler 105. The downstream end 94B of the fourth annular member 94 comprises a frusto-conical divergent downstream portion 95. In operation the main fuel supplied by internal fuel passages 70, fuel swirler and outlet 70A onto the radially inner surface 102 of the fifth annular member 96 is atomised by swirling flows of air from the swirl vanes 100 and 104 of the third and fourth air swirlers 101 and 105 respectively. The main inner air swirler passage 68 and the main outer air swirler passage 72 are arranged to swirl the air in opposite directions. Alternatively, the main inner air swirler passage 68 and the main outer air swirler passage 72 may be arranged to swirl the air in the same direction.

The fuel injector head 48 also comprises a plurality of circumferentially spaced swirl vanes which extend radially between the third annular member 78 and the fourth annular member 94 to form a fifth air swirler. An annular duct is defined between the third annular member 78 and the fourth annular member 94. The intermediate air swirler passage 66 comprises the annular duct. The intermediate air swirler passage 66 is sandwiched between the pilot outer air swirler passage 64 of the inner pilot air-blast fuel injector 54 and the main inner air swirler passage 68 of the outer main air-blast fuel injector 56.

The fourth annular member 94 forms a first splitter member arranged radially between the main inner air swirler passage 68 and the pilot outer air swirler passage 64 and the third annular member 78 forms a second splitter member arranged radially between the main inner air swirler passage 68 and the pilot outer air swirler passage 64. The second splitter 78 has a frusto-conical convergent portion 77.

The frusto-conical divergent downstream portion 95 of the first splitter member 94 and any frusto-conical divergent downstream portion of the second splitter 78 are arranged at the same angle relative to the axis Y of the fuel injector head 48. The frusto-conical divergent downstream portion of the second splitter member 78 and the frusto-conical divergent downstream portion 95 of the first splitter member 94 are arranged parallel to each other. However, the frusto-conical divergent downstream portion 95 of the first splitter member 94 and any frusto-conical divergent downstream portion of the second splitter 78 may be arranged at different angles relative to the axis Y of the fuel injector head 48.

The fuel injector 44 described above and shown in FIG. 5 comprises five air swirler passages 60, 64, 66, 68, 72. However, the invention is applicable to any fuel injector (which may also be called a fuel spray nozzle) using multiple swirlers nested into each other. For example, there may be only two air swirler passages. Optionally the fuel injector 44 has a single fuel line.

Optionally, the fuel injector 44 is a lean burn fuel injector. However, the invention is applicable to other types of fuel injector such as a rich burn fuel injector.

The invention has been described above in the context of a fuel injector 44 for a gas turbine engine 10. Such a gas turbine engine 10 can be for an aircraft. However, the invention is not limited to aircraft. For example, the fuel injector 44 could be used in a stationary gas turbine. As a further example, the fuel injector 44 could be used as part of an industrial combustor such as a furnace. Such an industrial combustor is not necessarily a gas turbine type.

As shown in FIG. 5, the fuel injector 44 comprises at least one cavity 2. The cavity 2 separates an exterior of the fuel supply passage 50, 52 from a body 4 of the fuel injector 44. The body 4 of the fuel injector 44 defines the shape of the fuel injector 44. The body 4 comprises components that have been described above. For example, the body 4 comprises the first generally cylindrical member 74, the second generally annular member 76, the third generally annular member 78, the fourth generally annular member 94, the fifth generally annular member 96 and the sixth generally annular member 98. These members form different parts of the body 4 of the fuel injector 44.

The cavity 2 is internal to the fuel injector 44. The cavity 2 distances the pilot fuel supply passage 50 and/or the main fuel supply passage 52 from the body 4. The cavity 2 is a region exterior to the fuel supply passage 50, 52 that is free from the material (e.g. metal) that forms the body 4 of the fuel injector 44.

As shown in FIG. 5, the cavity 2 is at least partially filled with a thermal insulating material 3. Optionally, the cavity 2 is substantially completely filled with the thermally insulating material 3. The filled cavity 2 is configured to be a thermal insulator between a hot surface that has been washed with gas and a cold surface that has been soaked with fuel. The thermally insulating material 3 helps to reduce the transfer of heat between the surfaces. Hence, the thermally insulating material 3 helps to keep down the temperature of the fuel soaked surface.

By keeping down the temperature of the fuel soaked surface (which can also be called a wetted wall), the rate of carbonaceous material deposition can be reduced. This helps the fuel injector 44 to maintain a higher performance for longer.

Additionally, or alternatively, the use of the thermally insulating material 3 means that the size of the cavity 2 can be decreased, without unduly increasing the heat transfer. Hence, the performance of the fuel injector 44 can be kept high while reducing the diameter of the head 48 of the fuel injector 44.

By reducing the diameter of the fuel injector head 48, the size of the apertures 37 in the upstream end wall 35 of the combustion chamber can be reduced. This helps to reduce the stress in the metal ligament between the apertures 37. This helps to increase the lifetime of the fuel injector 44. This also allows extra design freedom to have a thinner upstream end wall 35. This helps to reduce the mass of the fuel injector 44.

Optionally, the thermally insulating material has a lower thermal conductivity than air. For example, the thermally insulating material may have a thermal conductivity of at most 24 mW/mk, and optionally at most 20 mW/mk. This means that the provision of the thermally insulating material 3 reduces heat transfer between the hot and cold surfaces compared to if the cavity 2 were filled with air.

Optionally, the thermally insulating material 3 is a porous, solid material. Optionally, the thermally insulating material 3 has a density of at most 50 kg/m$^3$ and optionally at most 20 kg/m$^3$. By providing that the thermally insulating material 3 has a lower density, the presence of the thermally insulating material 3 does not significantly increase the mass of the fuel injector 44. Optionally, the thermally insulating material 3 comprises an aerogel. Optionally, the aerogel has a thermal conductivity of about 17 mW/mk. Alternatively, the thermally insulating material 3 may not be an aerogel. For example, a different low density, low thermal conductivity material could be used.

The thermally insulating material 3 blocks at least part of the cavity 2. This helps to reduce the possibility of undesirable ingress of fuel into the cavity 2. Fuel that reaches the interior of the cavity 2 can contribute to building up of carbonaceous material (i.e. coking deposits). Over time, this can lead to carbon jacking, where the carbonaceous material interferes with the position or movement of other components of the fuel injector 44. Carbon jacking involves the carbonaceous material pushing against other metal parts. Carbon jacking can potentially lead to critical failure of the fuel injector 44. The provision of the thermally insulating material 3 reduces the risk of carbon jacking by functioning as a blockage for fuel reaching inside the cavity 2.

The thermally insulating material 3 is arranged to block fuel supplied by the fuel supply passage 50, 52 from entering the cavity 2. Optionally, the thermally insulating material 3 fills an opening 5 (see FIGS. 6 and 7) where the cavity 2 opens to the environment. By filling the opening 5, the thermally insulating material 3 blocks fuel from entering into the cavity 2. This helps to prevent fuel from reaching parts of the cavity 2 that are not completely filled in by the thermally insulating material 3.

Optionally, the cavity 2 is unsealed to the environment. The environment means the immediate surroundings. For example, the environment may be one of the air swirler passages. Not sealing the cavity 2 increases manufacturing tolerances. By not sealing the cavity 2, it is easier to manufacture the fuel injector 44. Sealing off the cavity 2 is difficult because of the relative thermal movements between the hot and cold surfaces. As a result, leaving the cavity 2 unsealed simplifies the manufacturing process. Meanwhile, the thermally insulating material 3 reduces the risk of carbon jacking, without requiring the cavity 2 to have been sealed.

Optionally, neither of the pilot fuel supply passage 50 and the main fuel supply passage 52 surrounds the other. This simplifies the design of the fuel injector 44 and makes it easier to manufacture. This also helps to reduce the diameter of the head 48 of the fuel injector 44. The thermally insulating material 3 helps keep the temperature down without the need for the pilot fuel supply passage 50 to be wrapped around the main fuel supply passage 52.

Alternatively, the pilot fuel supply passage 50 may be wrapped around the main fuel supply passage 52. For example, in the head 48 of the fuel injector 44, part of the pilot fuel supply passage 50 (i.e. the pilot fuel supply circuit) may be wrapped around part of the main fuel supply passage 52 (i.e. the main fuel supply circuit). This helps to reduce the temperature of the fuel.

As shown in FIG. 5, the pilot fuel supply passage 50 and the main fuel supply passage 52 extend axially through the fuel feed arm 46. As shown in FIG. 5, optionally the pilot fuel supply passage 50 and the main fuel supply passage 52 are concentric as they extend through the fuel feed arm 46. In particular, the pilot fuel supply passage 50 may surround the main fuel supply passage 52. This helps keep the temperature of the fuel down. The pilot fuel supply passage 50 and main fuel passage 52 may surround each other in the pilot-mains heat exchanger to increase heat transfer from the main fuel passage 52 to the pilot fuel supply passage 50.

Alternatively, the fuel supply passage 50 and the main fuel supply passage 52 may be eccentric to each other as they extend through the fuel feed arm 46. In other words, fuel supply passage 50 and the main fuel supply passage 52 are staggered in the axial direction. For example, the pilot fuel supply passage 50 and the main fuel supply passage 52 may be positioned next to each other, but without one surrounding the other. This makes it easier to manufacture the fuel feed arm 46 of the fuel injector 44.

As shown in FIG. 5, optionally the cavity 2 (or part of it) is radially outward of the fuel supply passages 50, 52 and radially inward of the part of the body 4*a* that defines the fuel feed arm 46. The cavity 2 is at least partially filled with the thermally insulating material 3. Here the term 'radially' refers to the radial direction in respect to the axial direction defined by the axis of the fuel feed arm 46.

Figure 6:
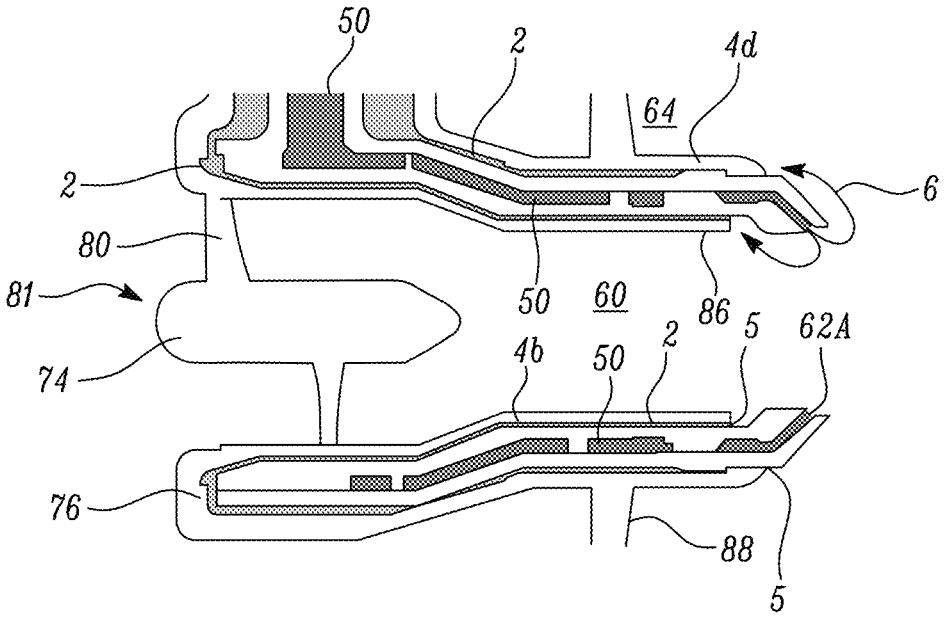
FIG. 6 is an enlarged cross-sectional view of an inner pilot air-blast fuel injector of the fuel injector.

FIG. 6 is an enlarged cross-sectional view of part of the fuel injector 44. In particular, FIG. 6 focuses on the first air swirler 81 of the inner pilot air-blast fuel injector 54. In FIG. 6, the arrows 6 show the path for ingress of fuel into the cavity 2 via the openings 5.

As shown in FIG. 6, optionally the cavity 2 (or part of it) is radially inward of the pilot fuel supply passage 50 and radially outward of the part of the body 4*b* that defines the pilot inner air swirler passage 60. The part of the body 4*b* that defines the pilot inner air swirler passage 60 may also be called the pilot heat shield. As indicated by the lower of the two arrows 6, it is possible for fuel to enter into the cavity 2 between the pilot heat shield and the pilot fuel supply passage 50. By filling the cavity with the thermally insulating material 3, fuel cannot enter as much (or at all) into the cavity 2. This reduces the possibility of carbon jacking that could otherwise result in deformation of part of the fuel injector 44, for example the pilot heat shield.

As shown in FIG. 6, optionally the cavity 2 (or part of it) is radially outward of the pilot fuel supply passage 50 and radially inward of the part of the body 4*d* that defines the pilot out air swirler passage 64. As shown by the upper of the two arrows 6 shown in FIG. 6, it is possible for fuel to enter into the cavity 2 at this position. The thermally insulating material 3 reduces any ingress of fuel into the cavity 2. Otherwise, the fuel can enter into the cavity 2 via the opening 5.

Figure 7:
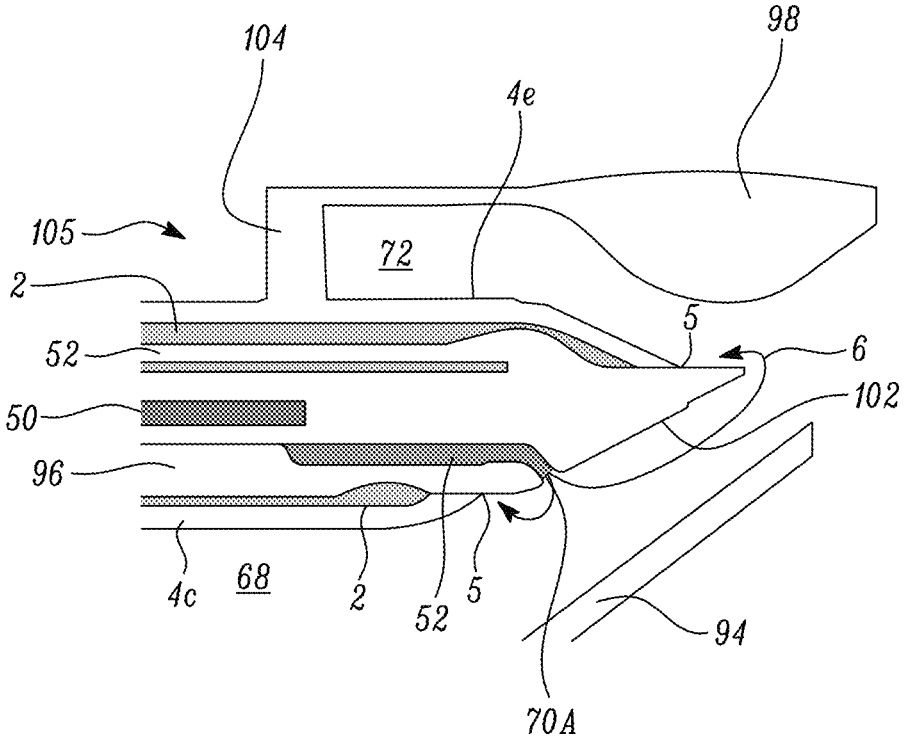
FIG. 7 is an enlarged cross-sectional view of an outer main air-blast fuel injector of the fuel injector.

FIG. 7 is an enlarged cross-sectional view of part of the fuel injector 44. In particular, FIG. 7 focuses on the outer main air-blast fuel injector 56. In FIG. 7, the arrows 6 show the path for ingress of fuel into the cavity 2 via the openings 5.

As show in FIG. 7, optionally the cavity 2 (or part of it) is radially inward of the main fuel supply passage 52 and radially outward of the part of the body 4*c* that defines the main inner air swirler passage 68. The thermally insulating material reduces any ingress of fuel into the cavity 2 via the opening 5.

As shown in FIG. 7, optionally the cavity 2 (or part of it) is radially outward of the main fuel supply passage 52 and radially inward of the part of the body 4*e* that defines the main outer air swirler passage 72. The thermally insulating material 3 in the cavity 2 reduces any ingress of fuel into the cavity 2 through the opening 5.

Optionally, during manufacture of the fuel injector 44, the thermally insulating material 3 undergoes a phase transition from a fluid to a solid. For example, optionally the thermally insulating material 3 is inserted (e.g. poured) into the cavity 2 as a fluid (e.g. liquid). This makes it easier to completely fill the cavity 2. The material undergoes a change to the solid state after a processing step for reducing the water content. This state change allows the cavity 2 to be blocked such that substantially no fuel can reach the cavity 2.

Figure 8:
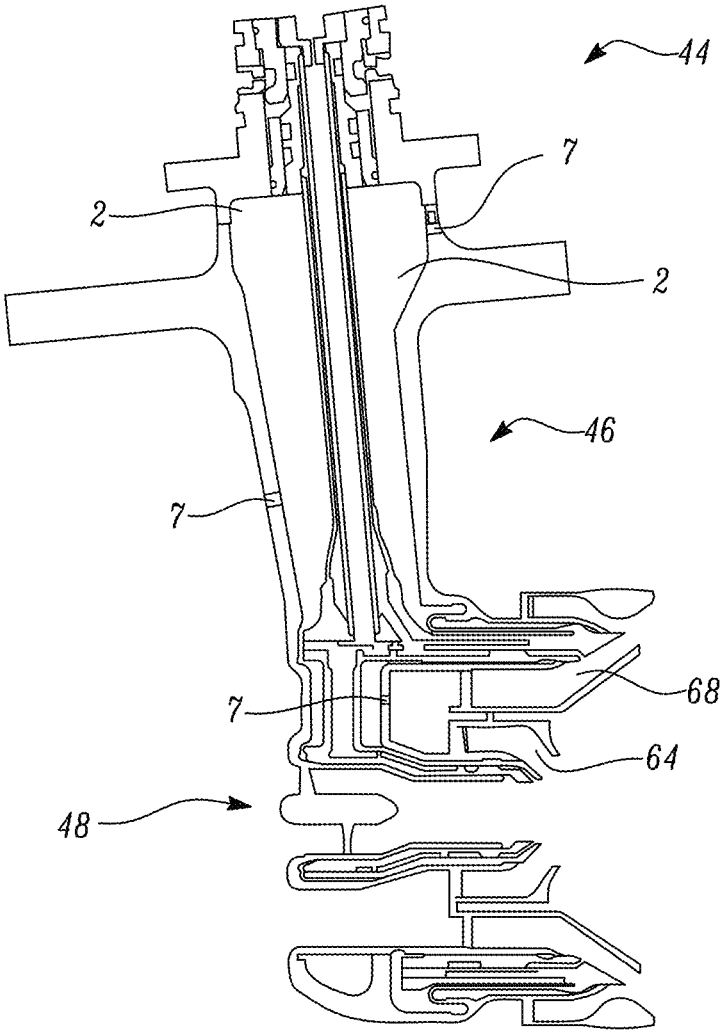
FIG. 8 is a cross-sectional view of the fuel injector.

FIG. 8 is a cross-sectional view of the fuel injector 44. As shown in FIG. 7, optionally the body 4 of the fuel injector 44 comprises at least one access hole 7. The access hole 7 is for allowing the thermally insulating material 3 to be injected into the cavity 2 from the exterior of the fuel injector 44. The access hole 7 provides for fluid communication between the exterior of the fuel injector 44 and the cavity 2. During manufacture, the access hole 7 is empty to allow the thermally insulating material 3 to be injected. Optionally, the thermally insulating material 3 blocks the access hole 7 in the fuel injector 44 once the fuel injector 44 is manufactured.

As shown in FIG. 8, optionally one or more access holes 7 are provided in the body 4*a* of the fuel feed arm 46. As also shown in FIG. 8, optionally at least one access hole 7 is provided in the fuel injector head 48 between the cavity 2 and a chamber that joins the pilot outer air swirler passage 64 with the main inner air swirler passage 68. Access holes 7 can additionally or alternatively be provided in other locations of the body 4 of the fuel injector 44.

It is not essential for access holes 7 to be provided. The cavity 2 can be filled at various stages of manufacturing the fuel injector 44. The cavity 2 may be filled at an earlier stage in a manufacturing process such that access holes 7 are not required to provide access to the cavity 2.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A fuel injector comprising:

a fuel injector head having a coaxial arrangement of an inner air swirler passage and an outer air swirler passage located radially outward of the inner air swirler passage; and a fuel feed arm that extends in a direction substantially perpendicular to the fuel injector head, wherein:

at least one fuel supply passage arranged in the fuel injector head and in the fuel feed arm in order to supply fuel into the inner air swirler passage and the outer air swirler passage;

a common cavity that extends through the fuel injector head and the fuel feed arm, the common cavity:

separates an exterior of the at least one fuel supply passage from a body of the fuel feed arm, includes passages coaxially arranged in the fuel injector head, and separates the inner air swirler passage and the outer air swirler passage;

the common cavity is filled with a thermally insulating material;

the thermally insulating material extends from a first end of the fuel feed arm on an opposite end to the fuel injector head to a second end of the fuel injector head on an opposite end of the fuel feed arm; and the thermally insulating material fills the common cavity via an opening at the second end of the fuel injector head where the common cavity opens to the environment.

2. The fuel injector of claim 1, wherein the thermally insulating material has a lower thermal conductivity than air.

3. The fuel injector of claim 1, wherein the thermally insulating material is arranged to block the fuel supply by the at least one fuel supply passage from entering the common cavity.

4. The fuel injector of claim 1, wherein the at least one fuel supply passage includes a pilot fuel supply passage and a main fuel supply passage, wherein neither of the pilot fuel supply passage and the main fuel supply passage surrounds the other.

5. The fuel injector of claim 1, wherein the at least one fuel supply passage includes a pilot fuel supply passage and a main fuel supply passage extending axially through the pilot fuel supply passage.

6. The fuel injector of claim 5, wherein the pilot fuel supply passage and the main fuel supply passage are eccentric to each other as the pilot fuel supply passage and the main fuel supply passage extend through the fuel feed arm.

7. The fuel injector of claim 1, wherein the thermally insulating material comprises an aerogel.

8. The fuel injector of claim 1, wherein the fuel injector is a lean burn fuel injector.

9. The fuel injector of claim 1, comprising the at least one fuel supply passage includes a pilot fuel supply passage and a main fuel supply passage extending through the pilot fuel supply passage, the inner air swirler passage comprising, in order radially outwardly, a coaxial arrangement of a pilot inner air swirler passage and a pilot outer air swirler passage, the pilot fuel supply passage being arranged to supply pilot fuel into at least one of the pilot inner air swirler passage and the pilot outer air swirler passage, the outer air swirler passage comprising, in order radially outwardly, a coaxial arrangement of a main inner air swirler passage and a main outer air swirler passage, the main fuel supply passage being arranged to supply main fuel into at least one of the main inner air swirler passage and the main outer air swirler passage.

10. The fuel injector of claim 9, comprising:

a first splitter member being arranged radially between the main inner air swirler passage and the pilot outer air swirler passage, the first splitter member having a frusto-conical divergent downstream portion; and a second splitter member being arranged radially within and radially spaced from the first splitter member, the second splitter member having a frusto-conical convergent portion, a downstream end of the second splitter member being arranged upstream of a downstream end of the first splitter member.

11. A gas turbine engine for an aircraft comprising:

an engine core comprising combustion equipment, a turbine, a compressor, and a core shaft connecting the turbine to the compressor;

a fan located upstream of the engine core, the fan comprising a plurality of fan blades; and a gearbox that receives an input from the core shaft and outputs drive to the fan so as to drive the fan at a lower rotational speed than the core shaft;

wherein the combustion equipment comprises at least one fuel injector according to claim 1.

12. The gas turbine engine according to claim 11, wherein:

the turbine is a first turbine, the compressor is a first compressor, and the core shaft is a first core shaft;

the engine core further comprises a second turbine, a second compressor, and a second core shaft connecting the second turbine to the second compressor; and the second turbine, the second compressor, and the second core shaft are arranged to rotate at a higher rotational speed than the first core shaft.

* * * * *